United States Patent [19]

Meltzer et al.

[11] 4,368,585

[45] Jan. 18, 1983

[54] DISPLAY FRAME FOR DECORATIVE OBJECT

[75] Inventors: Peter M. Meltzer, Glenview; Donald G. Gallagher, Chicago, both of Ill.

[73] Assignee: The Bradford Exchange, Ltd.

[21] Appl. No.: 269,747

[22] Filed: Jun. 2, 1981

[51] Int. Cl.[3] ..... G09F 1/12

[52] U.S. Cl. ..... 40/152.1; 40/10 R; 40/158 R

[58] Field of Search ..... 40/152, 152.1, 10 R; 248/488

[56] References Cited

U.S. PATENT DOCUMENTS

| | | | |
|---|---|---|---|
| 539,318 | 5/1895 | Wanner | 40/152 |
| 1,879,403 | 9/1932 | Monroe | 248/488 |
| 2,142,321 | 1/1939 | Maley | 248/488 |
| 2,614,778 | 10/1952 | Graves | 248/490 |
| 2,663,105 | 12/1953 | Woodbury | 40/152 |
| 2,686,641 | 8/1954 | Friedrich | 248/490 |
| 3,137,955 | 5/1964 | Villani | 40/209 |
| 3,740,016 | 6/1973 | Buescher | 248/488 |
| 3,952,435 | 4/1976 | Olsen | 40/152.1 |
| 4,286,400 | 9/1981 | MacPherson | 40/152 |

FOREIGN PATENT DOCUMENTS

| | | | |
|---|---|---|---|
| 812030 | 8/1951 | Fed. Rep. of Germany | 40/152 |

*Primary Examiner*—Gene Mancene
*Assistant Examiner*—Wenceslao J. Contreras
*Attorney, Agent, or Firm*—Dressler, Goldsmith, Shore, Sutker & Milnamow, Ltd.

[57] ABSTRACT

An improved display frame is disclosed for holding and displaying a disc-like object, such as a decorative collector's plate. The display frame is particularly suitable for use with a decorative plate made of crystal having an etching on its surface, in that the display frame includes gripping fingers for holding and maintaining the decorative plate in spaced relation from a non-reflective surface of the display frame. In this way, diffused light strikes and highlights the etching on the crystal plate, thereby enhancing the visual appearance and attractiveness of the plate.

8 Claims, 3 Drawing Figures

DISPLAY FRAME FOR DECORATIVE OBJECT

FIELD OF INVENTION

The subject invention pertains generally to display frames for decorative objects, and particularly to an improved display stand for a disc-like object, such as an ornamental plate, which enhances the visual appearance of the object when displayed.

BACKGROUND OF THE INVENTION

Decorative collector's plates have become increasingly popular with a great number of individuals for both collection and decorative display purposes. Many plates of this nature are both finely and artfully crafted, thus enhancing their visual appeal. Additionally, many collector's plates are issued in limited edition, thus increasing their appeal as collectible items, and frequently making them suitable for investment purposes.

One variety of these collector's plates which are particularly appealing are those crafted from etched crystal. These type of plates are generally transparent or semi-transparent in nature, and include an artfully executed etching, usually on the rear surface of the plate, so that the etching is clearly visible when viewed from the front.

Experience has shown that the visual attractiveness of a crystal plate of this description is embellished when the plate is displayed in spaced relation in front of a dark matte surface of low reflectivity. In this way, diffused light highlights the decorative etching provided on the surface of the plate, thus further enhancing its visual appeal. In view of this, a display frame arrangement for a crystal plate of this description which would securely maintain the plate in properly spaced relation to a dark, non-reflective background would significantly enhance the visual attractiveness and appeal of the plate when displayed.

SUMMARY OF THE INVENTION

In accordance with the subject invention, an improved display frame is provided for a disc-like decorative object, and is particularly suited for use in displaying ornamental etched crystal collector's plates as described above. The display frame comprises a generally circular, substantially rigid background frame member, which in the preferred embodiment is slightly larger than the plate to be displayed. The frame member includes a generally flat planar front surface in front of which the decorative plate is displayed. The display frame further includes a plurality of gripping fingers affixed to the frame member on its front surface, with each gripping finger being adapted to engage a peripheral edge portion of the decorative plate. The gripping fingers are each formed of resilient material, and are spaced about the front surface of the background frame member so that a decorative plate may be fitted within the fingers, and thereby held and maintained in evenly spaced relation from the flat front surface of the background frame member. In this way, diffused light backlights the decorative plate.

As noted, a decorative crystal plate of the type described is particularly visually appealing when maintained in spaced relation from a surface which is of low reflectivity or matte. To this end, the subject invention provides black flocking for the flat front surface of the background frame member, as well as for each of the gripping fingers affixed thereto. So that the decorative crystal plate may be conveniently displayed, the display frame of the subject invention further includes a removable display stand on the rear surface of the background frame member, as well as a suitable wall hanger for use when the display stand is removed.

Thus, the subject invention provides an economical yet effective display frame for decorative plates or the like, which is particularly suited for enhancing the visual appeal of etched crystal collector's plates.

DESCRIPTION OF THE PREFERRED EMBODIMENT

Figure 1:
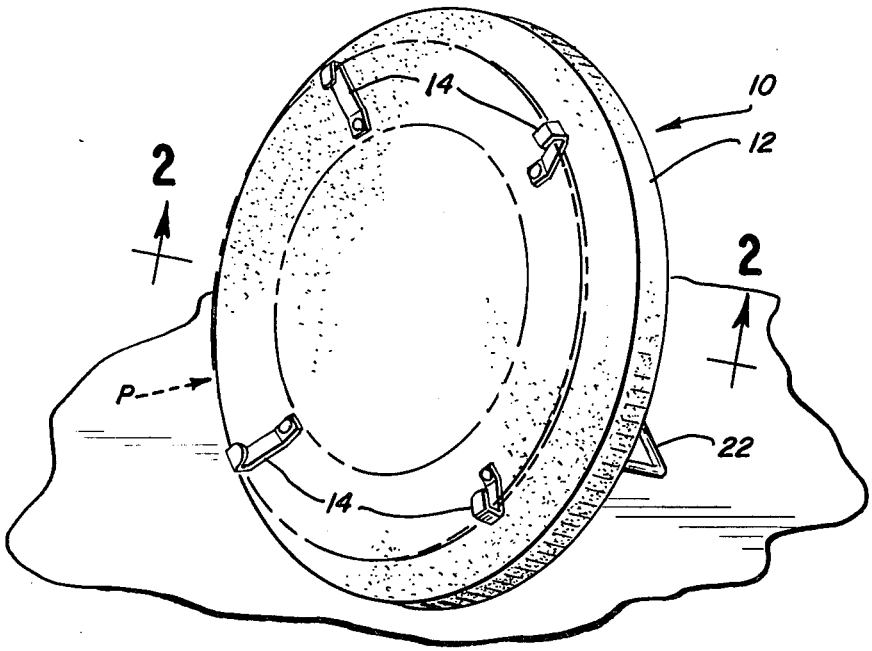
FIG. 1 is a front perspective view of the display frame of the subject invention, including a decorative collector's plate shown in phantom.

While the subject invention is susceptible to embodiment in different forms, there is shown in the drawings and will hereinafter be described a preferred embodiment with the understanding that the present disclosure is to be considered as an exemplification of the invention and is not intended to limit the invention to the embodiment illustrated.

With reference to FIG. 1, therein is illustrated the display frame 10 of the subject invention. The display frame 10 is shown in conjunction with a disc-like decorative or ornamental object, such as a decorative collector's plate P (shown in phantom).

Display frame 10 includes a generally circular background frame member 12. Frame member 12 is of substantially rigid construction, and may be suitably fabricated from wood, wood products, plastic, or metallic materials. In the preferred embodiment, the diameter of the frame member 12 would be greater than the diameter of the decorative plate P so that the plate P is suitably "framed" by the display frame 10.

Figure 2:
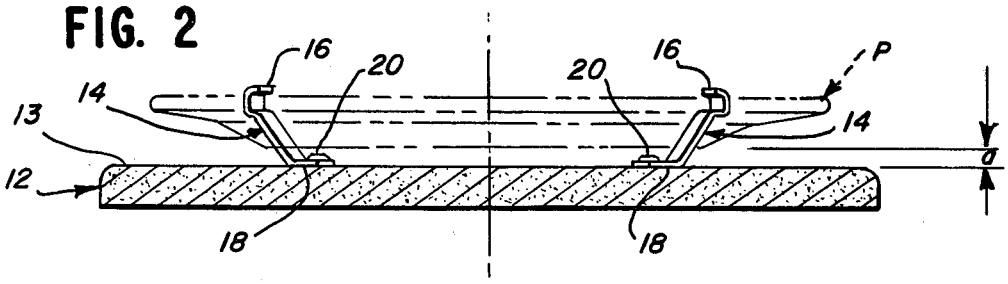
FIG. 2 is a cross-sectional view of the display frame illustrated in FIG. 1 taken along lines 2—2 of FIG. 1.

With reference now to FIGS. 1 and 2, display frame 10 includes a plurality of gripping fingers 14 affixed to the frame member 12 and extending outwardly from a flat, planar surface 13 of the frame member 12. Each of the fingers 14 is suitably formed from a resilient metallic material, or may be fabricated from a resilient plastic exhibiting the desired strength. Each finger 14 includes a hook-shaped free end portion 16 which is adapted to grip and engage a peripheral edge portion of the decorative plate P, and is connected to frame member 12 at its other end portion 18. Suitable mechanical fasteners 20, such as rivets, extend through the end portion 18 of each of the fingers 14 so that the fingers 14 are securely affixed to the frame member 12. Because decorative plates of the type for which the subject display frame is suitable for use may have substantial weight (frequently on the order of 1 to 1½ pounds), it is necessary that the gripping fingers 14 be sufficiently strong to support the weight of the plate P. Similarly, the frame member 12 should exhibit sufficient strength and rigidity so that the plate P is properly supported and held by the gripping fingers 14. Although the number of gripping fingers 14 may be varied, experience has shown that the use of four fingers 14 spaced at approximately right angles about the flat surface 13 of the frame member 12 provides the plate P with proper and secure support when the display frame 10 is maintained either inclined or upright.

With particular reference to FIG. 2, one of the significant features of the subject invention is illustrated in that gripping fingers 14 maintain and hold decorative plate P in evenly spaced relation to the flat surface 13 of frame member 12. This relation is clearly illustrated in that the rearmost surface of the plate P is evenly spaced a distance "a" from the flat surface 13 of the frame member 12. Spacing of the decorative plate P from its display frame 10 in this fashion has been found to significantly enhance the visual appeal and appearance of the plate P, particularly when the plate P is of the etched crystal type. This spacing permits diffused light to strike and backlight the rear surface of decorative plate P, and thereby highlight and embellish the etching provided on its rear surface. This particular arrangement has been found to be particularly effective when the dimension "a" is in the range of approximately $\frac{1}{8}$ to $\frac{1}{4}$ of an inch.

In order to further enhance the visual appearance of the decorative plate P when displayed by display frame 10, the preferred embodiment of the subject invention provides that the flat surface 13 of the frame member 12 as well as each of the gripping fingers 14 be coated with a dark material exhibiting low optical reflectivity. This particular feature has found to be significantly effective in enhancing the appearance of the plate P when it is of the etched crystal variety. The coating may comprise a non-reflective dark shade of matte paint, but it is preferred that a non-reflective, matte black or dark-shaded flocking be applied to the display frame. Not only does this provide a surface of low reflectivity which is best suited for display purposes of etched crystal plates, but it also provides the display frame 10 with a rich, textured finish which enhances the appearance of the display frame. Additionally, application of flocking to the hook-shaped end portions 16 of the gripping fingers 14 decreases the likelihood of this portion of the gripping fingers of scratching or marring the surface of the decorative plate. Naturally, each of the end portions 16 of the gripping fingers 14 may be provided with a coating of elastomeric material for improving the grip of the peripheral edge of the plate P, and for preventing scratching or marring of the plate's surface. Suitable rubber slip-on grommets could also be used.

Figure 3:
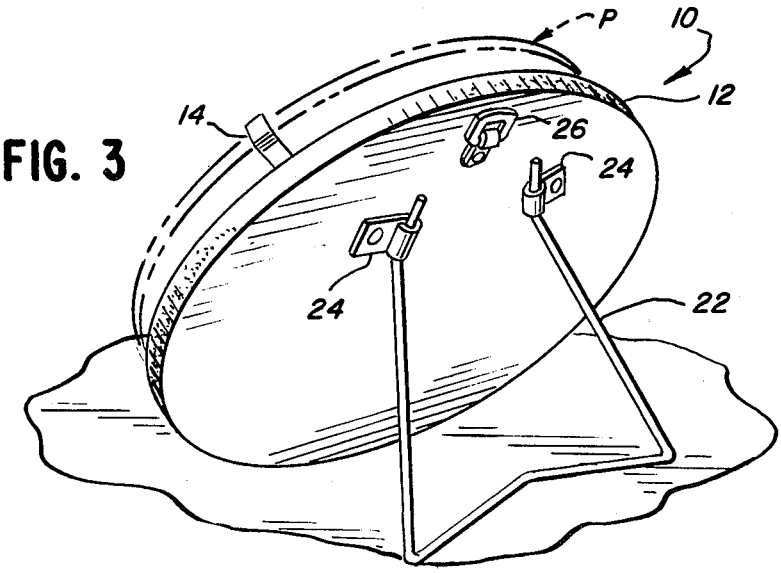
FIG. 3 is a rear perspective view of the frame illustrated in FIG. 1.

With reference now to FIG. 3, the display frame 10 is shown as including suitable arrangements for facilitating display. A removable support stand 22 is provided, fabricated from wire or the like, which slips and fits within a pair of support stand holders 24 suitably affixed to the rear surface of the display frame 10 by mechanical fasteners. The support stand 22 is dimensioned such that the frame member 12 of the display frame 10 (and the plate P) are maintained in inclined relation to a horizontal surface upon which the display frame 10 is placed. A suitable wall hanger 26 is also provided on the rear surface of the frame member 12 so that the display frame may be easily and conveniently hung on a wall or other vertical surface for display of the decorative plate P.

Thus, the subject invention provides a novel display frame arrangement for display and backlighting of decorative objects, particularly suited for use in displaying a decorative collector's plate made of crystal having an etching on its surface.

From the foregoing, it will be observed that numerous variations and modifications may be effected without departing from the true spirit and scope of the novel concept of the subject invention. It will be understood that no limitation with respect to the specific apparatus illustrated herein is intended or should be inferred. It is, of course, intended to cover by the appended claims all such modifications as fall within the scope of the claims.

What is claimed is:

1. An improved display frame for holding and displaying an associated decorative object, such as a plate, outwardly of a planar surface of said frame to permit backlighting of said decorative object, comprising:

a substantially rigid background frame member having a generally flat planar surface, said planar surface being continuous throughout its extent and adapted to substantially completely underlie said object, and said planar surface comprising material exhibiting low optical reflectivity relative to said decorative object, and a plurality of gripping finger means affixed to said background frame member on said flat surface, each finger means being adapted to engage a peripheral edge portion of said decorative object, said finger means being spaced from each other and extending outwardly of the planar surface of said frame member so that said decorative object is held by said finger means spaced from and adjacent to said planar surface, and said finger means each defining an edge engaging portion, said edge engaging portions being disposed in a common plane which is spaced from and generally parallel to said flat planar surface, whereby said finger means collectively maintain said object in evenly closely spaced relation outwardly of said flat planar surface, said edge engaging portions and said flat planar surface being spaced from one another by a dimension that is sufficient to permit diffused light from said surface exhibiting relatively low optical reflectivity to strike said decorative object to accommodate backlighting of said decorative object of enhancing its appearance during display.

2. The improved display stand of claim 1, wherein said finger means are covered with material exhibiting low optical reflectivity for enhancing the visual appeal of the displayed decorative object.

3. The improved display stand of claim 1 or 2, wherein said material comprises black flocking.

4. The improved display stand of claim 1, wherein each of said finger means comprises a resilient finger including a first end portion connected to said background frame member, and a second end portion providing said edge engaging portion having a generally hook-shaped configuration adapted to engage and retain a peripheral edge portion of said decorative object.

5. The improved display stand of claim 1, wherein said background frame member and said decorative object each having a disc-like configuration, the diameter of said frame member being greater than the diameter of said decorative object.

6. The improved display stand of claim 1, and frame stand means affixed to said background frame member and including a removable frame stand for maintaining said background frame member upright on a horizontal surface.

7. The improved display stand of claim 6, and hanger means affixed to said background frame member for hanging said frame member on a vertical surface.

8. The improved display stand of claim 1, wherein said decorative object is maintained in evenly spaced relation from said flat surface a distance in the range of approximately one-eighth to one-quarter inches.

* * * * *